US009463360B1

(12) United States Patent
Richard

(10) Patent No.: US 9,463,360 B1
(45) Date of Patent: Oct. 11, 2016

(54) NIGHT PUCK

(71) Applicant: Night Puck Technology Inc., Saint John (CA)

(72) Inventor: Ricky Richard, Saint John (CA)

(73) Assignee: Night Puck Technology, Inc., Saint John, N.B. (CA)

( * ) Notice: Subject to any disclaimer, the term of this patent is extended or adjusted under 35 U.S.C. 154(b) by 0 days.

(21) Appl. No.: 14/545,393

(22) Filed: Apr. 30, 2015

(51) Int. Cl.
*A63B 43/06* (2006.01)
*A63B 43/00* (2006.01)

(52) U.S. Cl.
CPC ..... *A63B 43/06* (2013.01); *A63B 43/002* (2013.01)

(58) Field of Classification Search
CPC ..... A63B 43/06
USPC ..... 473/588, 570; 446/485, 219; 362/641
See application file for complete search history.

(56) References Cited

U.S. PATENT DOCUMENTS

| | | | | | |
|---|---|---|---|---|---|
| 3,102,727 | A | | 9/1963 | Rice | |
| 4,183,536 | A | | 1/1980 | Platt | |
| 4,431,196 | A | * | 2/1984 | Kutnyak | A63H 33/18 473/588 |
| 4,846,475 | A | | 7/1989 | Newcomb et al. | |
| 4,968,036 | A | | 11/1990 | Von Der Mark | |
| 5,319,531 | A | * | 6/1994 | Kutnyak | A63H 33/18 362/184 |
| 5,348,298 | A | * | 9/1994 | Montgomery | A63B 67/14 473/446 |
| 5,697,858 | A | * | 12/1997 | Lekavich | A63B 67/14 473/588 |
| 6,126,561 | A | | 10/2000 | Von Der Mark | |
| 7,621,833 | B2 | | 11/2009 | Proulx et al. | |
| 8,727,918 | B1 | | 5/2014 | Gentile | |
| 8,727,919 | B1 | | 5/2014 | Gentile | |
| 2007/0275801 | A1 | * | 11/2007 | Proulx | A63B 67/14 473/588 |
| 2010/0172143 | A1 | * | 7/2010 | Cunius | F21V 29/004 362/373 |

FOREIGN PATENT DOCUMENTS

| | | |
|---|---|---|
| CA | 1305734 | 7/1992 |
| CA | 1308757 | 10/1992 |
| CA | 2106336 | 3/1994 |
| CA | 2614447 | 6/2008 |

* cited by examiner

*Primary Examiner* — Gene Kim
*Assistant Examiner* — Rayshun Peng
(74) *Attorney, Agent, or Firm* — Mario Theriault

(57) ABSTRACT

The night puck has a median plane contiguous with a circumference thereof. The centroid of the puck is located at an intersection of the axis of rotation of the puck with the median plane. A cylindrical cavity extends therein along the natural axis of rotation. This cylindrical cavity has a thin membrane-like bottom wall. A series of holes extend radially along the median plane from the cylindrical cavity to the circumference of the puck. An electronic module is mounted in the cylindrical cavity. This electronic module comprises a battery and has a center of gravity that is located on the centroid of the puck. A push-button switch is held against the membrane-like bottom wall for operation of the switch by a depression of the membrane-like bottom wall. A series of diodes are mounted in the radial holes and are connected to the electronic module, for illuminating rays of lights around the puck.

12 Claims, 3 Drawing Sheets

NIGHT PUCK

FIELD OF THE INVENTION

This invention pertains to illuminated hockey pucks, and more particularly, it pertains to illuminated hockey pucks having the same static and dynamic properties as standard regulatory hockey pucks.

BACKGROUND OF THE INVENTION

Pond hockey is perhaps the oldest form of hockey ever played. In recent years, there has been a renewed interest for this sport. There has been a renewed interest for pond hockey at nighttime, under the moonlight for example. Pond hockey is played during January, February and March basically when daylight time is relatively short. Therefore, pond hockey is often played in the afternoon until late evening. One example of such interest in the sport is the World Pond Hockey Championship tournament which has been held annually at the end of February, since 2002. This tournament is held on Roulston Lake in Plaster Rock, New Brunswick, Canada. A total of 120 teams from 15 countries participated to the 2015 tournament. Pond hockey is played by four players in each team, between nets that are six feet wide by ten inches high. The game is played without boards and without a goalie.

Because, this game is often played during the evening, there are numerous advantages to play with an illuminated hockey puck. Although all shots are kept low and relatively soft, a puck is often deflected away from the designated play area or over the net, and ends up in deep snow outside the play area. Therefore, in addition to an increased visibility during the game, an illuminated hockey puck is easier to find when it is inadvertently shot outside the play area.

Although pond hockey is used herein as an example, illuminated hockey pucks are also used when playing street hockey, backyard hockey and regular ice hockey.

When a hockey puck is modified to incorporate a circuit and light sources therein, it is important that the modified hockey puck retains a good balance. It is important that the modified hockey puck does not wobble, swirl or spiral when it is slid on the ice.

In recent years, there has been a number of inventions related to illuminated hockey pucks, for playing pond hockey, or for providing an increased visibility of the puck during televised games. The following documents represent a good inventory of the illuminated hockey pucks available in the prior art in North America.

U.S. Pat. No. 3,102,727 issued to T. C. Rice on Sep. 3, 1963;

U.S. Pat. No. 4,183,536 issued to N. W. Platt on Jan. 15, 1980;

U.S. Pat. No. 4,431,196 issued to M. R. Kutnyak on Feb. 14, 1984;

U.S. Pat. No. 4,846,475 issued to N. F. Newcomb et al. on Jul. 11, 1989;

U.S. Pat. No. 4,968,036 issued to E. Von Der Mark on Nov. 6, 1990;

U.S. Pat. No. 6,126,561 issued to E. Von Der Mark on Oct. 3, 2000;

U.S. Pat. No. 7,621,833 issued to H. Proulx et al. on Nov. 24, 2009;

U.S. Pat. No. 8,727,918 issued to R. Gentile on May 20, 2014;

U.S. Pat. No. 8,727,919 issued to R. Gentile on May 20, 2014;

CA Patent 1,305,734 issued to E. Von Der Mark on Jul. 28, 1992;

CA Patent 1,308,757 issued to N. Newcomb on Oct. 13, 1992;

CA Publication 2,106,336 published by D. Klassen on Mar. 30, 1994

CA Patent 2,614,447 issued to H. Proulx et al. On Oct. 8, 2013;

Although all the inventions of the prior art deserve undeniable merits, it is believed that the illuminated hockey pucks from the prior art do not have physical properties that are identical to standard hockey pucks. For examples, the weight and centroid of the puck may be different from that of a standard regulatory hockey puck.

Serious hockey players practice for years in the handling of a hockey puck with a hockey stick. Some players can even juggle and flip a puck on the blades of their sticks. These skilled players can slide, "saucer pass" and manoeuvre a puck with high accuracy. Skilled players can easily detect a puck that is out of balance, lighter or heavier than a standard puck.

For these reasons, it is believed that there is a need in this sport for an illuminated hockey puck that retains the static and dynamic properties of a standard regulatory hockey puck.

SUMMARY OF THE PRESENT INVENTION

In the present invention, there is provided an illuminated hockey puck that is referred to herein as a night puck. The night puck according to the present invention has an electronic module mounted therein. This electronic module is statically and dynamically balanced and weight-adjusted so that the centroid of the night puck and its total weight are unchanged from a standard regulatory hockey puck.

In a first aspect of the present invention, there is provided a hockey puck having a median plane contiguous with a circumference of the puck, and a natural axis of rotation extending at a right angle with the median plane. The centroid is located at an intersection of the axis of rotation and the median plane. A cylindrical cavity extends along and is centered on the natural axis of rotation. A series of radial holes extend along the median plane from the cylindrical cavity to the circumference of the puck. An electronic module including a battery is mounted in a snug fit manner in the cylindrical cavity, and a series of light emitting diodes (LED) are similarly mounted in the radial holes. The electronic module has a center of gravity located on the aforesaid centroid. The diodes are connected to the electronic module for illuminating rays of light around the circumference of the puck.

The nigh puck according to the present invention has a weight and balance that are within 2% of those of standard regulator puck. The nigh puck is stable and has a predictable behavior on the ice.

In another aspect of the night puck according to the present invention, the electronic module includes a metal casing that is mounted in the aforesaid cylindrical cavity. The metal casing has anchoring sleeves mounted radially therein. These sleeves are movable radially in and out of the metal casing for anchoring the casing into the puck. Because of these anchoring sleeves, the metal casing and the anchoring sleeves can be mounted inside the cylindrical cavity of the puck in a snug fit manner to avoid any play or looseness of these components inside the puck.

In another aspect of the present invention, the electronic module comprises a push-button switch. The cylindrical cavity has a membrane-like bottom wall and the push-button switch is held against that membrane-like bottom wall such that the switch can be operated by deflecting the membrane-like bottom wall.

In yet a further aspect of the present invention, the diameter of the cylindrical cavity and of the metal casing is about 40% of the total diameter of the night puck. The original material of the puck remaining outside the cylindrical cavity provides elasticity and bouncing energy to the night puck. Under pond hockey conditions where shots are kept low and moderately hard, the elastic response of the night puck has been found to be equivalent to the characteristics of a standard regulatory hockey puck.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

A preferred embodiment of the night puck according to the present invention is described with the aid of the accompanying drawings, in which like numerals denote like parts throughout the several views.

The drawings presented herein are presented for convenience to explain the functions of all the elements includes in the preferred embodiment of the present invention. Elements and details that are obvious to the person skilled in the art may not have been illustrated. Conceptual sketches have been used to illustrate elements that would be readily understood in the light of the present disclosure. Furthermore, the drawings presented herein are freehand sketches. Therefore, it should be understood that the drawings should not be scaled. It should be understood that straight lines are not always drawn straight and circle are not always perfectly round. Parallel, isometric or perspective features are not always illustrated as such. These drawings are presented to persons skilled in the art having a will to understand.

DESCRIPTION OF THE PREFERRED EMBODIMENT

Figure 1:
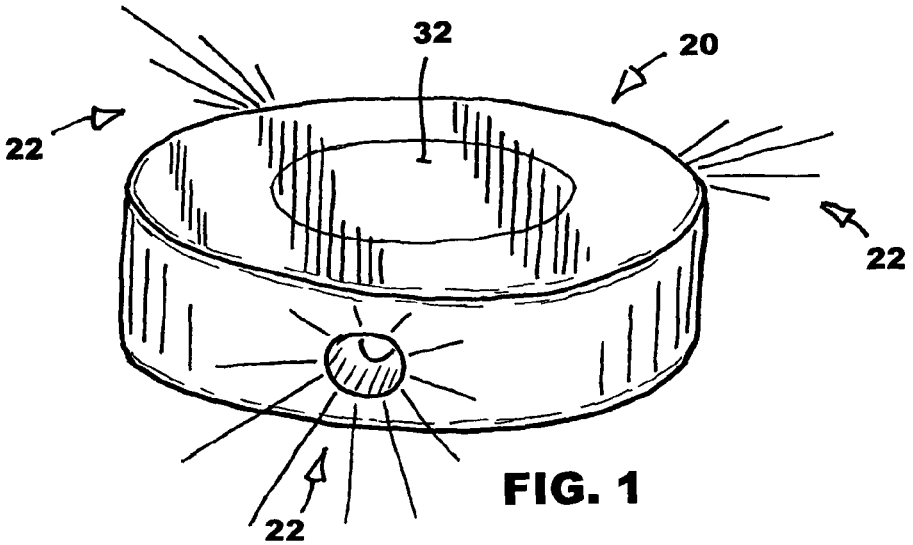
FIG. 1 is a perspective view of the entire night puck according to the preferred embodiment of the present invention.
Figure 2:
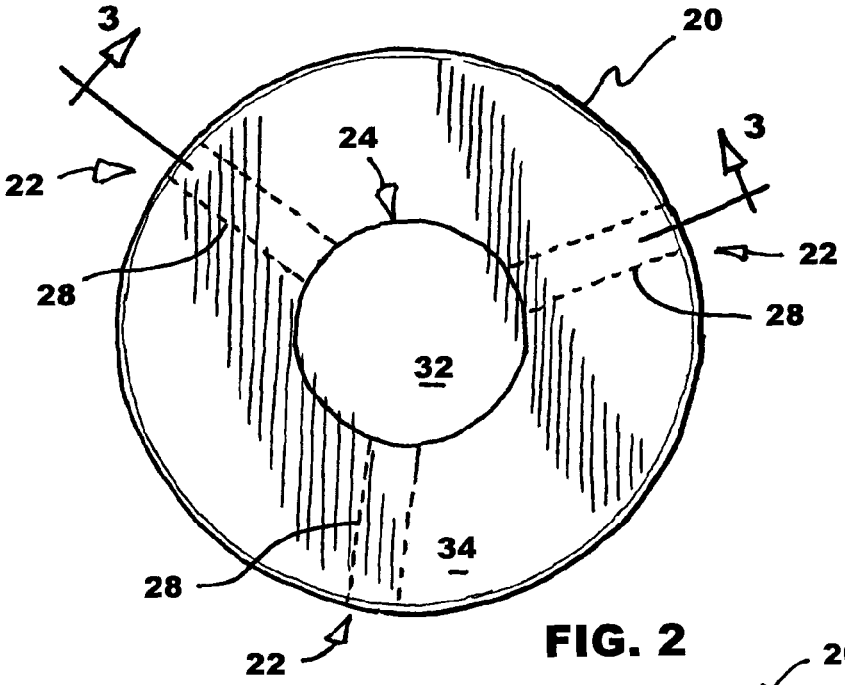
FIG. 2 is a plan view of the preferred night puck.
Figure 3:
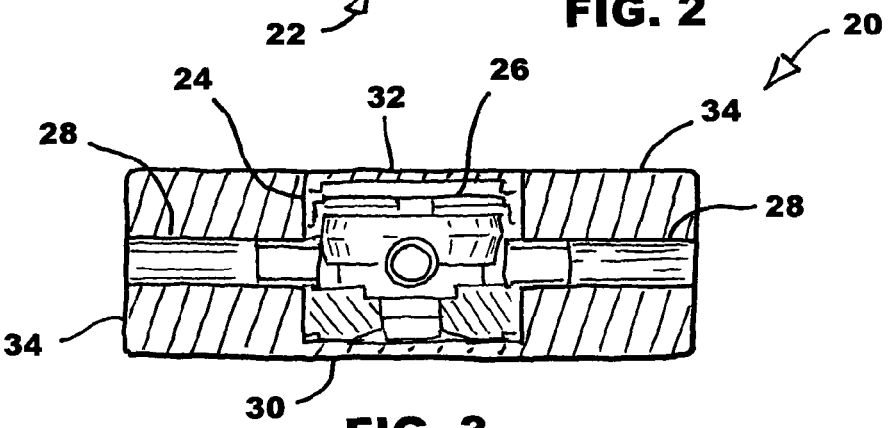
FIG. 3 is a cross section view of the preferred night puck as seen along lines 3-3 in FIG. 2.

Referring firstly to FIGS. 1 and 2, the preferred embodiment of the night puck according to the present invention is illustrated therein. As can be appreciated, the preferred night puck 20 has three light sources 22 equally spaced around its circumference. In use, the preferred night puck 20 rotates on the ice surface and its rotating light beams make it easy to see. It has been found that three rotating light sources 22 spaced at 120° from each other are sufficient for providing excellent visibility of the night puck 20.

As it may be appreciated, the preferred night puck 20 is manufactured from a standard regulatory hockey puck. A cylindrical cavity 24 is machined in its center, and an electronic module 26 is installed in that cavity 24. Three holes 28 are drilled along radii of the preferred night puck 20 and along the median plane of the puck, at 120° apart. Three light emitting diodes (LED) are installed in these radial holes 28, one in each hole.

The cylindrical cavity 24 is machined through the entire thickness of the puck 20, or preferably to a partial depth leaving a thin membrane-like wall 30 on the bottom surface of the puck 20, as illustrated. A rigid hard-rubber-like plug 32, which is made of the same material as the puck itself is mounted over the electronic module 26. The plug 32 is glued to the preferred night puck 20, on one side, or both sides of the puck if the cavity 24 extends throughout the entire thickness of the puck, so the outside surfaces of the puck are as smooth as a standard regulatory hockey puck.

The diameter of the central cavity 24 is about 40% of the diameter of the entire night puck 20. It has been found that this dimension leaves a ring 34 of original material around the electronic module 26, so the night puck retains a major portion of its resiliency and bouncing properties. Although the requirement for elasticity and bouncing energy of a pond hockey puck is not as stringent as it is in ice hockey, the retention of a ring 34 with the specified radial thickness contributes to maintaining the electronic module 26 substantially unnoticeable by pond hockey players.

Figure 4:
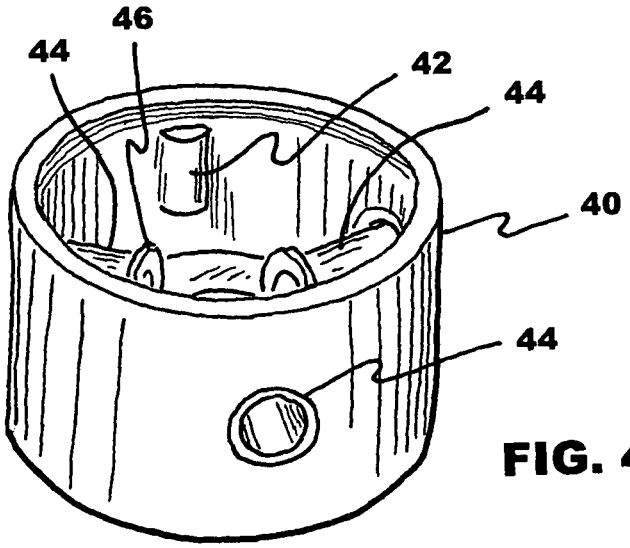
FIG. 4 is perspective view of the metal casing for insertion in the preferred night puck, shown with the anchoring sleeves retracted.
Figure 5:
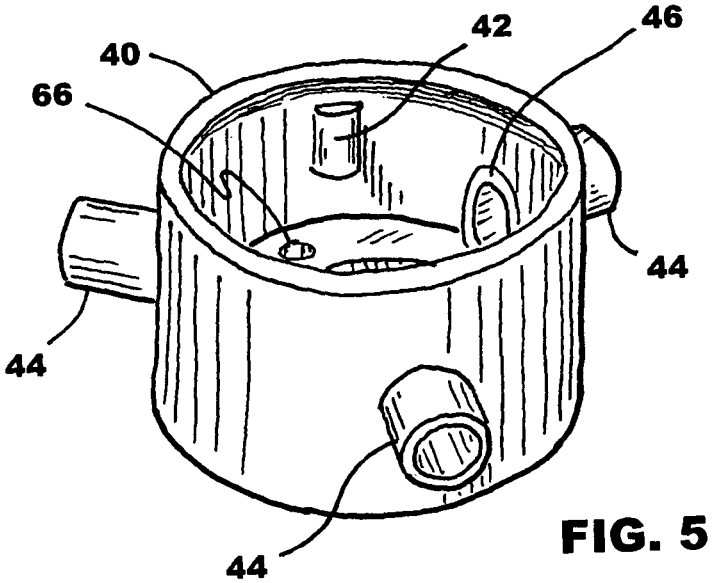
FIG. 5 is a perspective view of the metal casing of FIG. 4, shown with the anchoring sleeves extended.

Referring now to FIGS. 4 and 5, the metal casing 40 of the electronic module 26 will be described. This metal casing 40 is preferably made of aluminum. The aluminum material of the casing 40 also provides compressive elasticity and resilience to the entire night puck 20 to compensate for the material taken out from the cylindrical cavity 26.

The aluminum casing 40 has outside dimension that is a snug fit into the machined cylindrical cavity 24 mentioned above. The casing 40 has one or more balancing weights 42 molded or affixed therein to compensate for the weight distribution of the electronic components mounted therein. Each balancing weight 42 has dimensions and placement such as to bring back the center of gravity of the electronic module 26 to the centroid of the hockey puck 20 before it was modified. Therefore, it will be appreciated that the balancing weight 42 may not have a constant cross-section along the thickness of the casing 40. At other locations, the casing 40 has a uniform wall thickness and weight distribution that is centered around the centroid of the preferred night puck 20.

The one or more balancing weights 42 contribute to maintain a static balance of the electronic module 26 relative to the natural axis of rotation of the preferred night puck 20.

Another characteristic of the casing 40 is found in its three anchoring sleeves 44. Each sleeve 44 has a shoulder 46 on its inside extremity. Each sleeve can be extended or retracted radially from the casing 40 as it may be understood from FIGS. 4 and 5.

During installation of the electronic module 26 inside a puck, the anchoring sleeves 44 are retracted inside the casing 40, while the casing is tightly pressed into the machined cavity 24. Then, the anchoring sleeves 44 are extended outward, one in each of the radial holes 28 to anchor the casing 40 in place. Because of these retractable anchoring sleeves 44, it is possible to mount the electronic module 26 inside the cavity 24 and in the radial holes 28 in a snug fit manner to avoid any looseness in the mounting.

Figure 6:
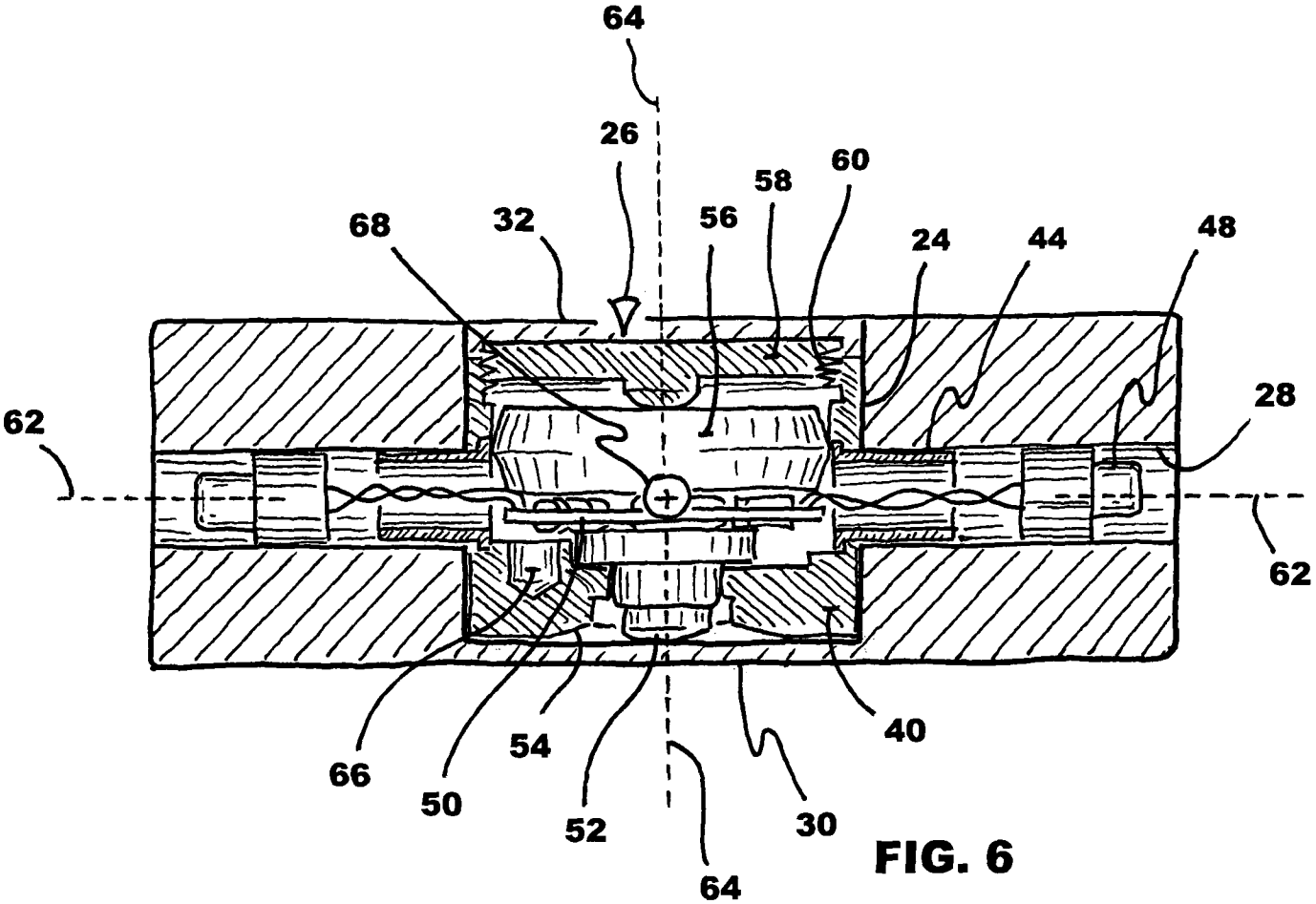
FIG. 6 is an enlarged cross-section view of FIG. 3 shown with the electronic components mounted therein.

Referring to FIG. 6, the light emitting diodes 48 are also mounted inside the radial holes 28 in a snug fit manner and glued therein with epoxy. The light emitting diodes 48 are connected to a circuit board 50, which comprises a press-button, on-off switch 52. The switch 52 is mounted in such a way as to hold the button against the membrane-like thin wall portion 30 of the hockey puck at the bottom of the cylindrical cavity 26. The switch 52 is operated on-off simply by holding the preferred night puck 20 in one's hand and pressing with the thumb against the center of the preferred night puck 20. In order to facilitate the flexing of the thin wall 30 during the operation of the switch 52, a tapering recess 54 has been provided in the bottom wall of the casing 40 around the push button of the switch 52.

Referring again to FIG. 6, a long-life battery 56 is mounted inside the casing 40 over the circuit board 50. An aluminum cover 58 closes the casing 40. Preferably, the cover 58 is mounted to the casing 40 on a watch-type fine thread 60 so that the casing 40 can be reopened and the battery 56 can be replaced when required.

In FIG. 6, it can be appreciated that the bottom portion of the aluminum casing 40 is thicker that the cover 58. The thicker bottom portion is provided to compensate for the weight of the battery 56, above the median plane 62 of the preferred night puck 20, so that the total weight of the casing and electronic components are in balance relative to the median plane 62 of the preferred night puck 20. A balance relative to the median plane 62 is referred to as a dynamic balance where the weight of the components do not create a couple force that could cause the nigh puck to wobble when shot or to easily flip when sliding on the ice.

As it can be appreciated, the one or more balancing weights 42 contribute to maintaining a static balance of the electronic module 26 relative to the natural axis 64 of rotation of the night puck 20. One or more balancing nips 66 may also be provided inside the casing 40 to fine-tune either one of the static or dynamic balance of the preferred electronic module 26.

It has been found that due to the balancing weights 42 and balancing nips 66, the final weight of the preferred night puck 20 can be adjusted to be within 2% of that of a standard regulatory hockey puck. It has also been found that the centroid 68 of the preferred night puck 20 can be adjusted to lie precisely at the intersection of the median plane 62 of the preferred night puck 20 with the natural axis 64 of rotation of the preferred night puck 20. Therefore, for all intents and purposes, the preferred night puck 20 has the same physical characteristics as a standard regulatory hockey puck.

What is claimed is:

1. A hockey puck comprising: a puck body having an overall diameter and an outside circumference; a median plane contiguous with said circumference; a natural axis of rotation extending at a right angle from said median plane; a centroid located at an intersection of said natural axis of rotation with said median plane; a cylindrical cavity inside said puck body extending along said natural axis of rotation and being centered on said natural axis of rotation said cylindrical cavity having a cavity diameter being smaller than said overall diameter of said puck body; a series of radial cylindrical holes extending radially in said puck body along said median plane, from said cylindrical cavity to said outside circumference_of said puck body; a metal casing snug-fit mounted in said cylindrical cavity: an electronic module mounted in said metal casing, said electronic module including a battery and having a center of gravity located on said centroid, and said metal casing being snug-fit mounted in said cylindrical cavity: said metal casing having a circumferential wall and radial circular openings in said circumferential wall, said metal casing having anchoring sleeves respectively extending radially through one of said radial circular openings and into one of said radial cylindrical holes of said puck body, for anchoring said metal casing to said puck body: and each of said anchoring sleeves having a shoulder thereon inside said metal casing for retaining said sleeves to said metal casing: and a series of light sources mounted in said anchoring sleeves and being connected to said electronic module, for illuminating rays of lights around said outside circumference.

2. The hockey puck as claimed in claim 1, wherein said series of light sources comprises three diodes.

3. The hockey puck as claimed in claim 1, further comprising a balancing weight therein mounted at a distance away from said natural axis of rotation.

4. The hockey puck as claimed in claim 3, wherein said metal casing has balancing weights and balancing nips incorporated therein at different distances from said natural axis of rotation and from said median plane.

5. The hockey puck as claimed in claim 4, wherein said electronic module comprises a push-button switch; said cylindrical cavity has a membrane-like bottom wall and said push-button switch is held against said membrane-like bottom wall for operation of said switch by a deflection of said membrane-like bottom wall.

6. The hockey puck as claimed in claim 1, wherein said cavity diameter is about 40% of said overall diameter.

7. The hockey puck as claimed in claim 1, wherein said series of radial holes comprises three radial holes spaced at 120° apart.

8. A hockey puck comprising: a puck body having an overall diameter and a circumference; a median plane contiguous with said circumference; a natural axis of rotation extending at a right angle from said median plane; a centroid located at an intersection of said natural axis of rotation with said median plane; a cylindrical cavity inside said puck body extending along said natural axis of rotation and being centered on said natural axis of rotation, a metal casing snug-fit mounted in said cylindrical cavity: an electronic module mounted in said metal casing, said electronic module including a battery and having a center of gravity located on said centroid, said electronic module comprising a metal casing, and said metal casing having a balancing weight and a balancing nip mounted therein: said balancing weight and said balancing nip being mounted at different distances from said natural axis of rotation and from said median plane for maintaining a static balance and a dynamic balance of said electronic module and said metal casing relative to said centroid.

9. The hockey puck as claimed in claim 8, wherein said metal casing comprises anchoring sleeves mounted radially therein and being movable in and out of said metal casing.

10. The hockey puck as claimed in claim 9, wherein each of said anchoring sleeves has a shoulder thereon inside said metal casing.

11. The hockey puck as claimed in claim 10, wherein said puck body has a series of radial holes therein extending radially along said median plane, from said cylindrical cavity to said circumference: and said series of radial holes comprises three radial holes spaced at 120° apart and each of said radial hole encloses one of said sleeves and each of said sleeves has a diode mounted snugly therein.

12. The hockey puck as claimed in claim 1, wherein said metal casing is made of aluminum, and a bottom wall of said casing is thicker than a cover of said casing for weight-compensating said battery relative to said centroid.

* * * * *